US007625115B2

(12) United States Patent
Gao et al.

(10) Patent No.: US 7,625,115 B2
(45) Date of Patent: Dec. 1, 2009

(54) METHOD OF BLENDING LUBRICANTS USING POSITIVE DISPLACEMENT LIQUID-HANDLING EQUIPMENT

(75) Inventors: Jason Zhisheng Gao, Rose Valley, PA (US); Alan Mark Schilowitz, Highland Park, NJ (US); Vera Minak-Bernero, Bridgewater, NJ (US); Peter Calcavecchio, Milford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 549 days.

(21) Appl. No.: 11/473,697

(22) Filed: Jun. 23, 2006

(65) Prior Publication Data

US 2007/0297279 A1 Dec. 27, 2007

(51) Int. Cl.
*B01F 15/04* (2006.01)

(52) U.S. Cl. ..... 366/160.5; 366/141; 366/144

(58) Field of Classification Search ..... 366/132, 366/134, 144–146, 151.1, 160.1–160.5, 162.3, 366/182.1, 152.1, 152.2, 162.1, 141; 222/54, 222/63, 134, 145.7, 319; 141/26; 422/922–929
See application file for complete search history.

(56) References Cited

U.S. PATENT DOCUMENTS

| | | | | |
|---|---|---|---|---|
| 3,908,862 | A * | 9/1975 | Chandra et al. | 222/63 |
| 4,938,080 | A | 7/1990 | Sarrine et al. | |
| 5,083,872 | A * | 1/1992 | Farling et al. | 366/138 |
| 5,415,324 | A | 5/1995 | Coventry | |
| 5,492,673 | A | 2/1996 | Curtis et al. | |
| 5,649,576 | A | 7/1997 | Kirk et al. | |
| 6,063,339 | A | 5/2000 | Tisone et al. | |
| 6,105,636 | A | 8/2000 | Scatizzi et al. | |
| 6,149,396 | A | 11/2000 | Bassani | |
| 6,196,057 | B1 | 3/2001 | Discenzo | |
| 6,302,168 | B1 | 10/2001 | Hu | |
| 6,387,330 | B1 | 5/2002 | Bova et al. | |
| 6,588,464 | B2 | 7/2003 | Scatizzi | |
| 6,698,462 | B2 | 3/2004 | Schneider | |
| 7,111,757 | B1 * | 9/2006 | O'Brien et al. | 222/71 |
| 2003/0111487 | A1 | 6/2003 | Peeler et al. | |

(Continued)

*Primary Examiner*—Charles E Cooley
(74) *Attorney, Agent, or Firm*—Robert A. Migliorini

(57) ABSTRACT

The present invention relates to a method of dispensing accurately small amounts of high viscosity lubricant components using tubeless positive-displacement liquid-handling equipment for forming lubricant blends. The method includes the steps of: providing a low void volume positive displacement pipette with a tapered tip for each lubricant component contained within a lubricant additive reservoir, and one or more lubricant blend containers; ingesting into a low void volume positive displacement pipette from a lubricant additive reservoir an ingestion volume of a lubricant component; moving the low void volume positive displacement pipette from the lubricant additive reservoir to the one or more lubricant blend containers; ejecting into the one or more lubricant blend containers an ejection volume of the lubricant component from the low void volume positive displacement pipette; returning the low void volume positive displacement pipette from the one or more lubricant blend containers to the additive reservoir; and repeating these steps for each additional lubricant component. The advantages of the method of the present invention include improved dispensing accuracy, quicker dispensing, lower shear rate during dispensing, lower temperature for dispensing, less residual additive on the tip of the device after dispensing, and the ability to real time monitor density and mass during dispensing. The method finds application in laboratory test environments, and in particular in high throughput testing environments.

56 Claims, 5 Drawing Sheets

Exemplary Schematic of a Lubricant Blend Station with Positive-Displacement Pipettes

U.S. PATENT DOCUMENTS

2003/0129093 A1 7/2003 Rogerieux et al.
2005/0095723 A1 5/2005 DiTrolio et al.
2005/0181512 A1 8/2005 Wollenberg
2007/0297279 A1* 12/2007 Gao et al. ..... 366/160.4
2009/0220385 A1* 9/2009 Brown et al.

* cited by examiner

Exemplary Schematic of a Low Void Volume Positive Displacement Pipette

Exemplary Schematic of a Low Void Volume Positive Displacement Pipette

Low Void Volume Positive Displacement Pipette in a Lubricant Additive Reservoir

Exemplary Schematic of an Array of Additive Reservoirs

Additive Reservoir Array 30

Exemplary Schematic of a Lubricant Blend Station with Positive-Displacement Pipettes

METHOD OF BLENDING LUBRICANTS USING POSITIVE DISPLACEMENT LIQUID-HANDLING EQUIPMENT

FIELD OF THE INVENTION

The present invention relates to the field of lubricant blending. It more particularly relates to an improved method of accurately blending highly viscous additives into lubricants. Still more particularly, the present invention relates to a method of dispensing accurately small amounts of high viscosity lubricant components using positive-displacement pipettes.

BACKGROUND OF INVENTION

Lubricants are generally mixtures of several components. The largest fraction of the blended lubricant is a mineral oil or synthetic basestock that typically makes up more than 80 percent of the total volume. The remainder of the lubricant consists of various additives which impart performance improving attributes such as antioxidancy, antiwear, foam reduction and the like. Additional additives, known as viscosity modifiers, are also sometimes added to thicken the lubricant and improve the viscosity versus temperature attributes of the lubricant. Viscosity modifiers are made of relatively high molecular weight polymeric molecules that can be quite viscous. Basestocks are much lower in viscosity. Consequently, lubricant blending equipment and methods usually necessitate dispensing components that span a wide viscosity range.

In order to make a blend in a laboratory, one typically transfers liquid lubricant components into the blending vessel by using pipettes. Standard pipettes are operated by air-displacement, i.e., controlling gas pressure inside the pipette. Vacuum is applied to pull liquid into the pipette and pressure is applied to expel liquid from the pipette. In many cases, use of a calibrated pipette results in accurate blending. However, pipetting and transferring high viscosity liquids, such as viscosity modifiers, may result in inaccuracies from several sources. The use of air or gas pressure to expel liquid from the pipette may result in different amounts of liquid transfer depending on the gas pressure and viscosity of the liquid. Viscous liquids generate significant resistance to the applied gas pressure and gas compression may result in less liquid than desired being ejected from the pipette. In addition, polymeric viscosity modifiers may form stringy residue near the tip inside the pipette, resulting in less liquid dispensed in the receiving vessel. These problems are especially severe when trying to make small laboratory blends which require a high degree of accuracy because small blends may only contain milligrams of total mass. Accurate blending requires that individual component volumes be measured with microliter accuracy, and component mass be measured with milligram or better accuracy.

A further limitation of air displacement pipettes is that they require connection to a pump or vacuum system. In the case of manually operated pipettes, a rubber bulb is typically utilized. However, in a robotic liquid handling system, tubing is typically connected to each pipette. In many cases, a system liquid is also used to help the transfer of the pump action to the pipette tips and an air gap is used to separate the system liquid from the liquid to be transferred (a combination of air and liquid displacement). This can be quite cumbersome when many pipettes are used. For example, if many blend components are being used, each component requires its own pipette to avoid having to continuously clean pipettes. With air displacement or combination of air/liquid displacement pipettes, each pipette must be connected to a pump, which may not be practical. Alternatively, one pipette may be utilized, but this necessitates repeated cleaning of the pipette between each use of a different component. In the case where a system liquid is used, there is also a possibility of cross-contamination between the system liquid and the lubricant additives.

High viscosity lubricant components are often derived from high molecular weight polymers. Thus, high viscosity lubricant components may degrade when subjected to high shear conditions. High shear results when a high viscosity lubricant is forced through a small orifice at high pressure, which may cause permanent rupture of molecular bonds. It is therefore desirable when pipetting high viscosity lubricant components to maintain a relatively low shear rate when ingesting them into the pipette, and also when expelling them from the pipette. In some cases, the blending process may be improved by heating high viscosity components thereby reducing their viscosity. It is desirable to minimize the need for heating components because lubricant components may degrade at elevated temperature.

A need exists for an improved method of accurately blending highly viscous additives into lubricants to alleviate the aforementioned issues associated with the prior art techniques of blending lubricants.

SUMMARY OF INVENTION

It has been discovered that a method of blending lubricant additives using positive-displacement liquid-handling equipment for lubricant blends resolves many of the issues with the prior art methods of blending lubricants.

In one embodiment, the present invention provides an advantageous method of accurately blending high viscosity lubricant components with tubeless positive displacement pipettes to form a lubricant blend comprising the following steps: providing a low void volume positive displacement pipette for each lubricant component contained within a lubricant additive reservoir, and one or more lubricant blend containers; ingesting into the low void volume positive displacement pipette from the lubricant additive reservoir an ingestion volume of a lubricant component; moving the low void volume positive displacement pipette from the lubricant additive reservoir to the one or more lubricant blend containers; ejecting into the one or more lubricant blend containers an ejection volume of the lubricant component from the low void volume positive displacement pipette; returning the low void volume positive displacement pipette from the one or more lubricant blend containers to the additive reservoir; and repeating the ingesting, the moving, the ejecting and the returning steps for each additional lubricant component to form a lubricant with additives properly dispensed. The positive displacement pipettes and the lubricant reservoir may also be heated to allow for more efficient liquid transfer.

In another embodiment, the present invention provides an advantageous method of accurately blending high viscosity lubricant components with tubeless positive displacement pipettes to form a lubricant blend comprising the following steps: providing a low void volume positive displacement pipette for each lubricant component contained within a lubricant additive reservoir, a heating means for the lubricant additive reservoir, one or more lubricant blend containers, a balance for weighing a mass of the one or more lubricant blend containers, and a robotic means coupled to a computer or programmable logic controller for coordinating and controlling the following steps; heating one or more lubricant components with a high viscosity to a temperature below about 110° C.; ingesting into the low void volume positive displacement pipette from the lubricant additive reservoir an ingestion volume of a lubricant component; moving the low void volume positive displacement pipette from the lubricant additive reservoir to the one or more lubricant blend containers; ejecting into the one or more lubricant blend containers an ejection volume of the lubricant component from the low void volume positive displacement pipette; weighing and controlling a mass of each lubricant component ejected into the one or more lubricant blend containers with the balance; returning the low void volume positive displacement pipette from the one or more lubricant blend containers to the additive reservoir; and repeating the ingesting, the moving, the ejecting, the weighing and the returning steps for each additional lubricant component.

In yet another embodiment, the present invention provides an advantageous method of accurately blending high viscosity lubricant components with tubeless positive displacement pipettes to form a lubricant blend comprising the following steps: providing a low void volume positive displacement pipette for each lubricant component contained within a lubricant additive reservoir, a heating means for the lubricant additive reservoir, one or more lubricant blend containers with a volume less than 10 milliliters, a balance for weighing a mass of the one or more lubricant blend containers, and a robotic arm connected to a support bridge coupled to a computer or programmable logic controller programmed with one or more lubricant blend recipes for coordinating and controlling the following steps; heating one or more lubricant components with a viscosity greater than about 500 centipoise at 100° C. to a temperature of less than about 110° C.; ingesting into the low void volume positive displacement pipette from the lubricant additive reservoir an ingestion volume of a lubricant component; moving the low void volume positive displacement pipette from the lubricant additive reservoir to the one or more lubricant blend containers; ejecting into the one or more lubricant blend containers an ejection volume of the lubricant component from the low void volume positive displacement pipette at a shear rate of less than about $1\times10^5$ $sec^{-1}$; weighing and controlling a mass of each lubricant component ejected into the one or more lubricant blend containers with the balance; returning the low void volume positive displacement pipette from the one or more lubricant blend containers to the additive reservoir; and repeating the ingesting, the moving, the ejecting, the weighing and the returning steps for each additional lubricant component.

Numerous advantages result from the advantageous method of blending lubricant additives using positive-displacement liquid-handling equipment disclosed herein and the uses/applications therefore.

For example, in exemplary embodiments of the present disclosure, the disclosed method of blending lubricant additives using positive-displacement liquid-handling equipment provides for improved accuracy of dispensing high viscosity additives into lubricants.

In a further exemplary embodiment of the present disclosure, the disclosed method of blending lubricant additives using positive-displacement liquid-handling equipment provides for a method of accurately producing small lubricant blends, which may be used in high throughput experimentation type of environments.

In a further exemplary embodiment of the present disclosure, the disclosed method of blending lubricant additives using positive-displacement liquid-handling equipment provides for dispensing of high viscosity lubricant components without shear induced degradation of the components.

In a further exemplary embodiment of the present disclosure, the disclosed method of blending lubricant additives using positive-displacement liquid-handling equipment provides for less stringy residue at the pipette tip upon discharge.

In a further exemplary embodiment of the present disclosure, the disclosed method of blending lubricant additives using positive-displacement liquid-handling equipment provides for a means of more quickly dispensing small volumes of high viscosity lubricant components.

In another exemplary embodiment of the present disclosure, the disclosed method of blending lubricant additives using positive-displacement liquid-handling equipment provides for minimal heating of lubricant additives, and therefore less degradation and discoloration prior to discharge.

In another exemplary embodiment of the present disclosure, the disclosed method of blending lubricant additives using positive-displacement liquid-handling equipment provides for a means to measure in real time the density of the lubricant additive being dispensed into the lubricant.

In still yet another exemplary embodiment of the present disclosure, the disclosed method of blending lubricant additives using positive-displacement liquid-handling equipment provides for a means to measure in real time the mass of lubricant additive being dispensed into the lubricant.

These and other advantages, features and attributes of the disclosed method of blending lubricant additives using positive-displacement liquid-handling equipment of the present disclosure and their advantageous applications and/or uses will be apparent from the detailed description which follows, particularly when read in conjunction with the figures appended hereto.

DETAILED DESCRIPTION OF THE INVENTION

Figure 1:
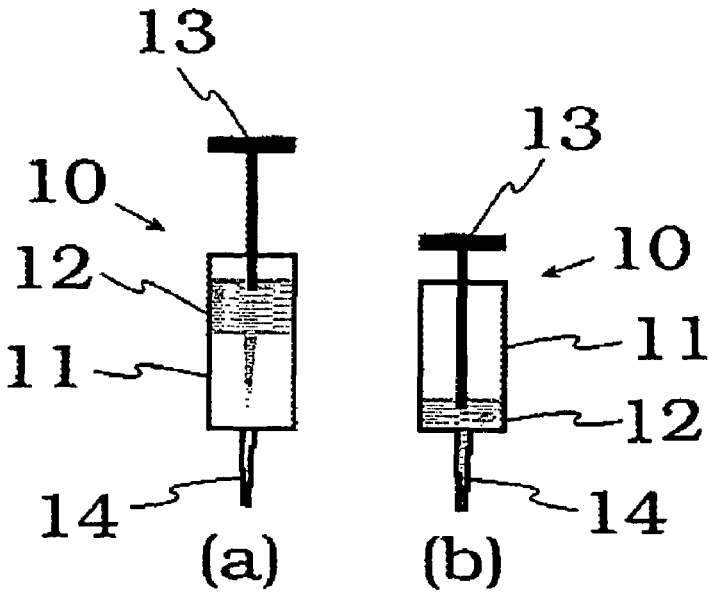
FIG. 1 depicts an exemplary schematic of a low void volume positive displacement pipette of the present invention.

The present invention relates to a method of blending high viscosity lubricant components comprising the use of positive-displacement pipettes. The method of blending high viscosity lubricant components of the present invention are distinguishable over the prior art in disclosing the use of positive displacement pipettes to accurately meter small quantities of high viscosity lubricant additives into a lubricant formulation. The advantages of the disclosed method of the present invention include, inter alia, improved dispensing accuracy, lower shear rate during dispensing, lower temperature for dispensing, less residual additive on the tip of the device after dispensing, and the ability to real time monitor density and mass during dispensing.

Blends made according to volume concentration are generally made using air displacement pipettes or air/liquid displacement liquid handling systems. In an air displacement pipette, a source of air is attached to the end of the pipette and suction is applied to draw fluid into the pipette. The pipette is then placed in the receiving vessel and gas is applied to eject liquid into the receiving vessel. In a combined air/liquid displacement liquid handling system, the suction is provided by a pump and action is transferred through a system liquid and the air gap between the system liquid and the liquid to be transferred. Different pipettes can be used for each lubricant component. Alternatively, a single pipette may be used if it is cleaned between exposure to different lubricant blend components in order to avoid contamination and inaccuracies.

In some applications, for example in laboratory applications, it is desirable to make very small quantities of lubricant blends. Small blends enable testing of precious additives made experimentally in small quantities and help to minimize waste when only small amounts are needed for testing purposes. It is also sometimes desirable to rapidly make large arrays of small lubricant blends. In this way lubricant blend compositions can be rapidly evaluated in various lubricant screening procedures. The process of rapidly making large arrays of small test samples and rapidly evaluating them is known as high throughput experimentation (HTE).

Lubricants are typically blended from several components of different molecular weight and viscosity. High viscosity lubricant components are sometimes used to modify the viscometric properties of the lubricant blend. These viscosity modifiers are typically comprised of high molecular weight polymers. It is especially difficult to accurately measure the volume of high viscosity lubricant components blended into small blends when air displacement pipettes are used in a conventional way because of two factors. One factor is that viscous liquids generate significant resistance to the applied gas pressure, and gas compression can result in less liquid being ejected from the pipette than anticipated. A second factor is that because high viscosity lubricant components are typically polymers, they tend to form a stringy residue inside the pipette near tip. Consequently, less liquid ends up in the receiving vessel than was expelled from the pipette, which may lead to blending inaccuracies. The error introduced by these two factors is exacerbated when making small blend quantities.

In many cases high viscosity lubricant components are blended after heating them to a temperature sufficient to reduce their viscosity to a range where they can be handled like low viscosity liquids. Alternatively, they may be diluted with low viscosity solvents. In this way they can be easily pipetted with standard air displacement pipettes and can be accurately dispensed. However, elevated temperature can cause high viscosity lubricant components to discolor or degrade. It is therefore desirable to blend them with minimal heating.

Another issue is that high viscosity lubricant components may degrade under high shear flow conditions. Shear degradation may occur when such additives are forced under pressure through a small orifice such as the exit opening on a pipette. High viscosity lubricant components are often comprised of high molecular weight polymers. When these polymers are forced through a small opening, the shear rate and shear stress may be sufficiently high to cause breaking of chemical bonds, which lowers the molecular weight and the associated benefits of the high molecular weight molecules in the lubricant blend.

An object of the present invention is to improve the accuracy of small lubricant blends containing high viscosity lubricant components made in a laboratory without causing degradation of the high viscosity lubricant component. In making a lubricant blend containing several components, it is necessary to accurately monitor the concentration of each component of the blend. When a blend is relatively large in volume, it is less complex to measure the concentration of individual components. Typically blends can be made by controlling the concentration by weight of each component or by volume of each component.

A further object of the present invention is to provide a method for accurately producing small lubricant blends, which include high viscosity lubricant components. These small lubricant blends contain preferably less than 100 milliliters of total volume, more preferably less than 25 milliliters of total volume, and even more preferably less than 10 milliliters of total volume.

The present invention relates to the discovery that accuracy of small lubricant blends containing high viscosity components can be improved by using pipettes activated by movement of a piston with a shaft all the way to the tip, which are defined as positive displacement pipettes (herein also referred to as "PDP"). Such pipettes are typically gear driven and generate sufficient pressure to ensure that all liquid residing in the pipette barrel is ejected. PDPs improve blend accuracy because the piston displaces a constant volume of liquid regardless of liquid viscosity. However, the piston may generate high pressure in the liquid, which is particularly relevant when using pipettes with a small orifice as is necessary when making small blend quantities. When using pipettes with a small orifice to dispense high viscosity lubricant components, shear rate and shear stress must be such as to not cause degradation of the lubricant components. Shear rate and shear stress are proportional to the rate of flow through an orifice, and therefore to minimize lubricant degradation, it is important to keep flow rates below certain threshold shear rates. The flow rate of the high viscosity component flowing through an orifice should be controlled to keep the shear rate below $5\times10^6$ $sec^{-1}$, preferably below $1\times10^6$ $sec^{-1}$, more preferably below $1\times10^5$ $sec^{-1}$, and even more preferably below $1\times10^4$ $sec^{-1}$.

The disclosed method of blending lubricant additives using tubeless positive-displacement pipettes is particularly suitable for dispensing high viscosity lubricant components or additives. A high viscosity lubricant component or additive is defined as a liquid with a viscosity greater than 100 centipoise at 100° C. The method of the present invention is particularly suitable for dispensing lubricant components or additives with a viscosity of greater than 500 centipoise at 100° C., and even more particularly suitable for dispensing lubricant components or additives with a viscosity of greater than 1000 centipoise at 100° C.

Lubricant Additives

Lubricant additives or components include, but are not limited to, viscosity modifiers, dispersants, detergents, pour point depressants, polyisobutylenes, high molecular weight polyalphaolefins, antiwear/extreme pressure agents, antioxidants, demulsifiers, seal swelling agents, friction modifiers, corrosion inhibitors, and antifoam additives, as well as packages containing mixtures of these lubricant additives, such as for example mixtures of dispersants, detergents, antiwear/extreme pressure agents, antioxidants, demulsifiers, seal swelling agents, friction modifiers, corrosion inhibitors, antifoam additives, and pour point depressants. High viscosity lubricants include, but are not limited to, viscosity modifiers, pour point depressants, dispersants, polyisobutylenes, and high molecular weight polyalphaolefins and additive packages containing one or more of these high viscosity lubricants. The disclosed method of blending lubricant additives using positive-displacement liquid-handling equipment method also allows blending to be done with minimal chemical, thermal or physical degradation of the high viscosity lubricant components within the lubricant blend.

Viscosity Modifiers

Viscosity modifiers (also known as VI improvers and viscosity index improvers) provide lubricants with high and low temperature operability. These additives impart higher viscosity at elevated temperatures, and acceptable viscosity at low temperatures.

Suitable viscosity index improvers include high molecular weight (polymeric) hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include olefin copolymer and hydrogenated styrene-isoprene copolymer of 50,000 to 200,000 molecular weight.

Viscosity modifiers are used in an amount of about 1 to 25 wt % on an as received basis. Because viscosity modifiers are usually supplied diluted in a carrier or diluent oil and constitute about 5 to 50 wt % active ingredient in the additive concentrates as received from the manufacturer, the amount of viscosity modifiers used in the formulation can also be expressed as being in the range of about 0.20 to about 3.0 wt % active ingredient, preferably about 0.3 to 2.5 wt % active ingredient. For olefin copolymer and hydrogenated styrene-isoprene copolymer viscosity modifier, the active ingredient is in the range of about 5 to 15 wt % in the additive concentrates from the manufacturer, the amount of the viscosity modifiers used in the formulation can also be expressed as being in the range of about 0.20 to 1.9 wt % active ingredient, and preferably about 0.3 to 1.5 wt % active ingredient.

Dispersants

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. Pat. Nos. describing such dispersants, and incorporated by reference in their entirety, are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458, also incorporated by reference in their entirety. A further description of dispersants may be found, for example, in European Patent Application No. 471 071, also incorporated by reference in its entirety.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044, all of which are incorporated by reference in their entirety.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenyl-polyamines such as polyethylene polyamines. One example is propoxylated hexamethylenediamine. Representative examples are shown in U.S. Pat. No. 4,426,305, which is incorporated by reference in its entirety.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are also shown in U.S. Pat. Nos. 3,697,574; 3,703,536; 3,704,308; 3,751,365; 3,756,953; 3,798,165; and 3,803,039, all of which are herein incorporated by reference in their entirety.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N-(Z-NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are disclosed, for example, in U.S. Pat. Nos. 3,275,554; 3,438,757; 3,565,804; 3,755,433; 3,822,209 and 5,084,19; all of which are herein incorporated by reference.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2.721,878; and 3,250,715, all of which are herein incorporated by reference, describe useful pour point depressants and/or the preparation thereof. Such additives may be used in an amount of about 0.01 to 5 wt %, preferably about 0.01 to 1.5 wt %.

Typical Additive Amounts

When lubricating oil compositions contain one or more of the additives discussed above, the additive(s) are blended into the composition in an amount sufficient for it to perform its intended function. Exemplary amounts of such additives useful in the present invention are depicted in Table 1 below. Note that many of the additives are shipped from the manufacturer and used with a certain amount of base oil solvent in the formulation. Accordingly, the weight amounts in the table below, as well as other amounts referenced in the present disclosure, unless otherwise indicated, are directed to the amount of active ingredient (that is the non-solvent portion of the ingredient). The weight percentages indicated below are based on the total weight of the lubricating oil composition.

TABLE 1

Typical Amounts of Various Lubricant Oil Components

| Compound | Approximate Wt % (Useful) | Approximate Wt % (Preferred) |
|---|---|---|
| Viscosity Modifier | 1-25 | 3-20 |
| Detergent | 0.01-6 | 0.01-4 |
| Dispersant | 0.1-20 | 0.1-8 |
| Friction Reducer | 0.01-5 | 0.01-1.5 |
| Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

Commercial additive packages usually include, but are not limited to, one or more detergents, dispersants, friction reducers, antioxidants, corrosion inhibitors, and anti-wear additives.

An exemplary, but not limiting, engine oil formulation will contain 70-90 wt % base oil, 4-10 wt % VI improver, 4-10 wt % dispersants, 1-3 wt % antiwear/extreme pressure agents, 0.2-2 wt % antioxidants, 1-4% detergents, 0.01-0.1 wt % each of demulsifier, seal swelling agent, friction modifier, and antifoam additive, 0.1-0.5 wt % pour point depressant. In some cases, some of these additives are packaged together by an additive supplier. In these additives, the VI improver and dispersants are high viscosity components (13,000-17000 centipoise under low shear condition). When heated to about 90° C., the viscosities of these two components decrease to a viscosity from about 500 to about 2000 centipoise under low shear conditions, which are still difficult to handle with the traditional liquid handling equipment.

Many PDPs have a piston or plunger which slides inside a barrel, the tip of which is tapers to a fine point. Sometimes this tip can be very fine, especially where a high degree of blend accuracy is desired. If the piston and barrel are not be fitted to one another when the piston is pressed into the barrel to eject a volume of liquid, not all the liquid will be ejected because there is a void volume between the piston and the barrel. In addition, air can be trapped between the piston and the liquid. Low Void Volume Positive Displacement Pipettes (herein also referred to as "LVVPDP") are pipettes that have pistons or plungers matched in shape and size to the pipette barrel and dispensing tip or needle. This minimizes the gap between the plunger or piston and the inside of the pipette barrel and dispensing tip/needle. In a LVVPDP, the void volume is less than 1 milliliter, preferably less than 0.5 milliliter, more preferably less than 0.05 milliliter, and even more preferably less than 0.5 microliter or essentially zero to minimize the amount of liquid or air trapped between the piston and the liquid. A LVVPDP may be alternatively defined by the % volume of the dispensing tip or needle that is filled by the plunger. For this alternative definition of a LVVPDP, it is one having at least 70% of the volume of the dispensing tip or needle filled by the plunger, therefore resulting in a void volume of the tip or needle of 30% or less of the total volume of the tip or needle. More preferably, a LVVPDP is one having at least 90% of the volume of the dispensing tip or needle filled by the plunger, therefore resulting in a void volume of the tip or needle of 10% or less of the total volume of the tip or needle. Even more preferably, a LVVPDP is one having at least 98% of the volume of the dispensing tip or needle filled by the plunger, therefore resulting in a void volume of the tip or needle of 2% or less of the total volume of the tip or needle.

Figure 2:
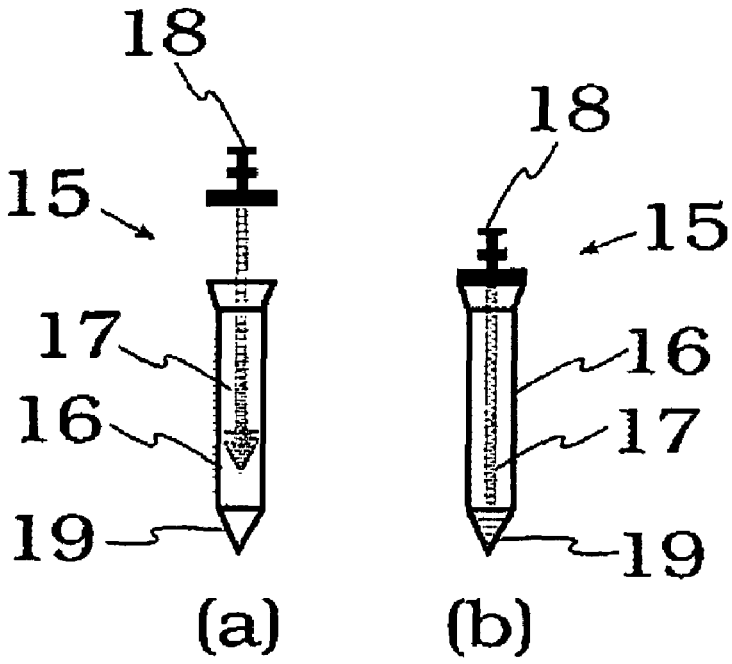
FIG. 2 depicts an alternative exemplary schematic of a low void volume positive displacement pipette of the present invention.

Two representative types of low void positive displacement pipettes are shown in FIGS. 1 and 2. The components of the LVVPDP may be made out of plastic, glass or metal. Polypropylene is a preferred plastic. FIG. 1 is one exemplary embodiment of a low void volume positive displacement pipette 10 for use in the present invention. The LVVPDP 10 is a syringe-like injector that may be disposable or non-disposable. A non-disposable device may be reused, whereas a disposable device is intended for single use. In many applications, the pipettes might be used multiple times for the same components. The LVVPDP 10 includes a barrel 11, a plunger 12 fitted to the barrel 11, an actuator 13 for the plunger 12, and a dispensing tip or needle 14. The dispensing tip or needle 14 preferably has a tapered design. The high viscosity lubricant fills the volume of the barrel 11 below the plunger 12 and into the tip or needle 14. The actuator 13 may be moved up and down by either a manual means or via a robotic means. One schematic (a) of FIG. 1 depicts the plunger 12 in the up or fill position, and the other schematic (b) of FIG. 1 depicts the plunger in the down or dispensing position. Schematic (b) of FIG. 1 also shows the close fit between the plunger 12 and the barrel 11 such as to minimize the void volume when the plunger is fully actuated.

FIG. 2 is another exemplary embodiment of a low void volume positive displacement pipette 15 for use in the present invention. The LVVPDP 15 includes a barrel 16, a plunger 17 fitted to the barrel 16, an actuator 18 for the plunger 17, and a dispensing tip or needle 19. The barrel 16, plunger 17, and tip or needle 19 are of an alternative shape that minimizes the void volume between the plunger 17, and the inside of the barrel 16 and dispensing tip or needle 19. This minimizes the void volume when the plunger 12 is fully actuated. One schematic (a) of FIG. 2 depicts the plunger 17 in the up or fill position, and the other schematic (b) of FIG. 2 depicts the plunger in the down or dispensing position.

An advantage of using a LVVPDP to dispense lubricant additives is that individual pipettes may be used for each individual additive. In the case of air-displacement or liquid/air displacement pipettes, each pipette requires a separate pump. This results in a cumbersome system when many pipettes are used. LVVPDPs do not require pumps, and therefore equipment complexity and the possibility of contamination are avoided. Correspondingly, the overall lubricant blending system is simplified when using LVVPDPs.

Figure 3:
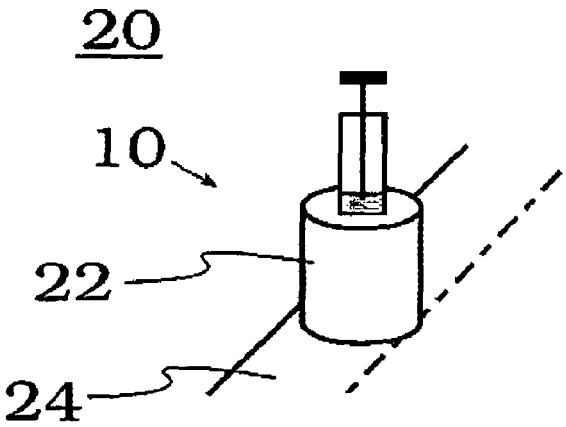
FIG. 3 depicts an exemplary schematic of a low void volume positive displacement pipette in a lubricant additive reservoir.

FIG. 3 is an exemplary schematic of a low void volume positive displacement pipette in a lubricant additive reservoir 20. In this case, a LVVPDP 10 is inserted into an additive reservoir 22 containing lubricant (not shown). The additive reservoir 22 is surrounded by a heating block 24 so that the high viscosity lubricant component (not shown) can be heated to reduce its viscosity. The additive reservoir 22 may be covered by a septum (not shown). VI improvers, pour point depressants, dispersants, polyisobutylenes, high molecular weight polyalphaolefins and other high viscosity lubricant components are typically heated from about 70 degrees C. to about 100 degrees C. to decrease their viscosity for ingestion into and ejection out of the LVVPDP 10. Additives packages containing one or more of these high viscosity Lubricant components are typically heated from about 40 degrees C. to about 60 degrees C. to decrease their viscosity for ingestion into and ejection out of the LVVPDP 10.

Figure 4:
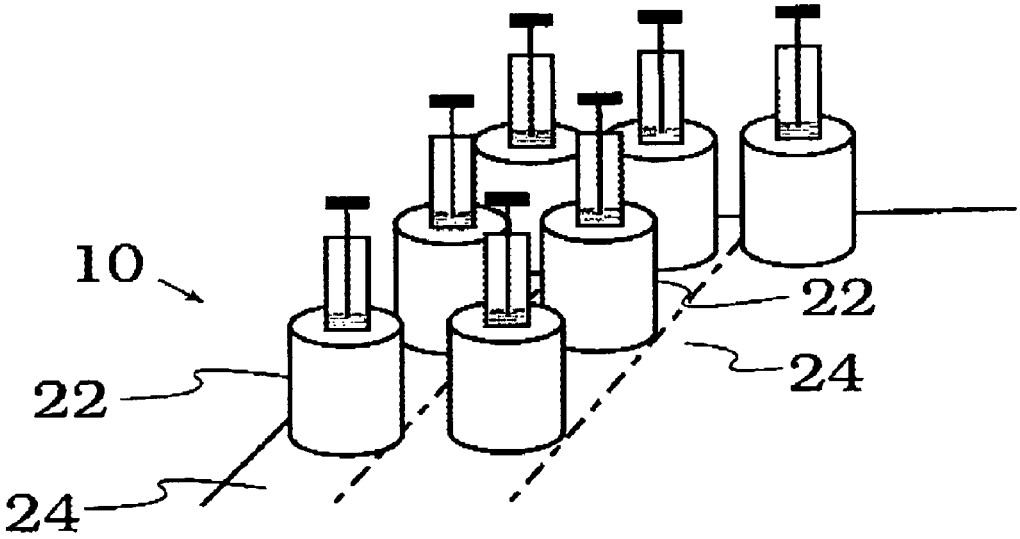
FIG. 4 depicts an exemplary schematic of an array of additive reservoirs.

FIG. 4 is an exemplary schematic of an array of additive reservoirs 30. Each additive reservoir 22 is surrounded by a heating block 24. Each additive reservoir 22 may contain a different high viscosity lubricant additive (not shown), as well as its own dedicated LVVPDP 10 to avoid issues associated with cross contamination of lubricant additives. There may be from 1 to a multitude of heating blocks 24 depending upon the type and number of lubricant additives. A heating block 24 may also control from one to a multitude of additive reservoirs 30. The heating blocks 24 may be controlled to a temperature ranging from room temperature to up to about 100 degrees C. depending upon the type of additive.

Figure 5:
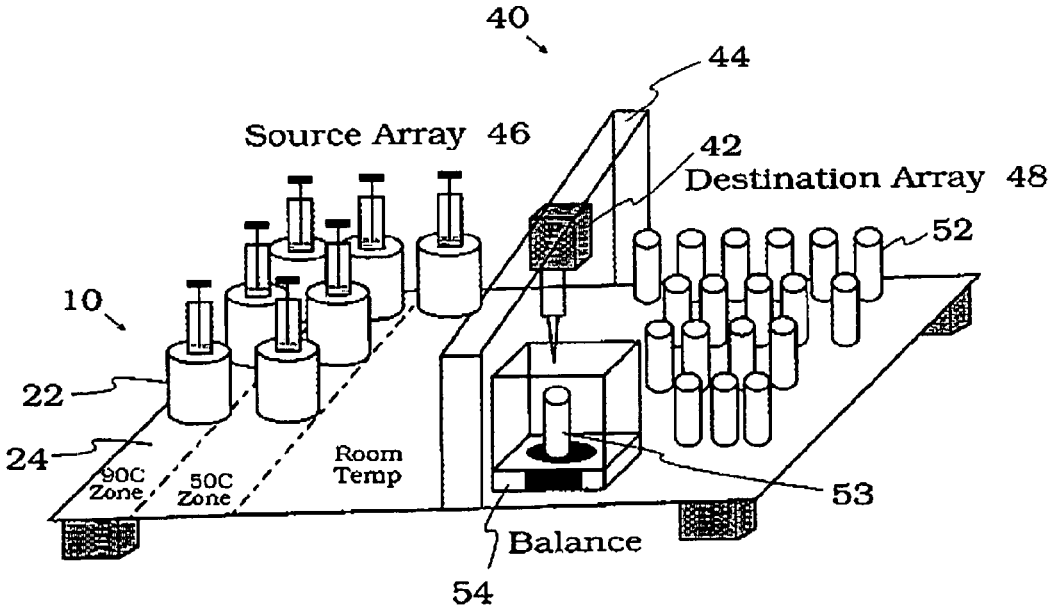
FIG. 5 depicts an exemplary schematic of a lubricant blend station based on the use of positive-displacement pipettes.

FIG. 5 is an exemplary schematic of a lubricant blend station 40 based on the use of LVVPDPs. In this embodiment of the present invention, a robotic means is used to control the movement of LVVPDPs 10, ingestion of lubricant component from the lubricant additive reservoir 22, and ejection of lubricant into a destination blend container 52. An exemplary, but not limiting robotic means, includes a robotic arm 42 connected to a support bridge 44 as shown in FIG. 5. The robotic arm 42 is used to select a LVVPDP 10 from its respective additive reservoir 22 in the LVVPDP source array 46 and transport the LVVPDP 10 to the LVVPDP destination array 48.

The source array 46 may also include one or more heating blocks 24 to preheat the high viscosity additive in order to lower the viscosity. For example, in FIG. 5, there are three heating zones 24 shown with one at 90° C., a second at 50° C., and a third at room temperature. The destination array 48 includes a series of destination blend containers 52 for delivery of the high viscosity additive. The destination array 48 may also include a balance 54 for weighing the amount of lubricant additive deposited into a destination blend container positioned on the balance 53. The robotic arm 42 positions the LVVPDP 10 above the destination blend container 53 that is positioned on top of the balance 54 and injects the additive into the blend container 53. The robotic arm 42 may then optionally inject the additive from the same LVVPDP 10 into one or more other destination blend containers 52. The robotic arm 42 then moves the LVVPDP 10 back to the original additive reservoir 22 of the source array 46. No washing of the line and the tip of the LVVPDP 10 is needed between each use as the additive remains constant in each additive reservoir 22. Each additive reservoir 22 and/or destination blend 52 container may also have a septum (not shown) to reduce the amount of viscous additive coating the needle or tip of the LVVPDP 10.

The robotic arm 42 and support bridge 44 are controlled by a computer or a programmable logic controller (not shown) to control their movement relative to the source array 46 and the destination array 48 in order to pick-up and return LVVPDPs 10. The robotic arm 42 controlled by a computer or a programmable logic controller (not shown) is also used to control the amount of additive sucked into the LVVPDP 10 at the source array 46 from each additive reservoir 22 and the amount of additive dispensed at the destination array 48 into each destination blend container 52. The computer or programmable logic controller contains information on all the additives contained in the additive reservoirs 22. This information includes, but is not limited to, physical properties such as viscosity and density. The computer also has a list of blend recipes, which includes the concentration of each additive in the blend recipe. The computer or programmable logic controller also has a feedback control mechanism to the balance for controlling the weight of each additive component dispensed into the destination blend container 53. The computer or programmable logic controller includes a calibration routine for the stroke of the plunger 12 in the barrel 11 and needle 14 of the LVVPDP 10 versus the weight of a particular lubricant additive dispensed. The calibration routine and feedback control mechanism allows the lubricant blend station 40 of the present invention to more quickly and accurately dispense lubricant additive components into a destination blend container 53 positioned on the balance 54.

As the computer directs a LVVPDP 10 to withdraw a specific volume of high viscosity lubricant component from an additive reservoir 22 and deposit it into a destination blend container 53, it may make two or more measurements. The computer monitors the volume of high viscosity lubricant component withdrawn by the LVVPDP 10. In addition, the mass of high viscosity lubricant component deposited into the destination blend container 53 is measured by the balance 54 sitting under the destination blend container 53. The destination blend container for lubricants may accommodate less than 100 milliliters in volume, and preferably less than 10 milliliters in volume for producing small lubricant blends.

The LVVPDP 10 associated with each additive reservoir 22 in the source array 46 may also be a disposable-type pipette. In this case, the robotic arm 42 will pick up a disposable LVVPDP 10, move it to the appropriate additive reservoir 22 depending on the additive desired, load the disposable LVVPDP 10 with additive, move to the destination blend container 52 (could be on top of a balance), and inject the lubricant additive into the blend container 52. The destination blend container 53 may also optionally be sitting on the balance 54 at the time of injection to measure real time the weight of lubricant additive being dispensed. The disposable LVVPDP 10 is discarded once the additive has been added to all the required destination blend containers 52.

The positive displacement technology of the present invention still requires heating to handle high viscosity lubricant additives. However, by enabling more accurate blending of high viscosity lubricant components, the use of LVVPDPs results in more accurate blends without excessive heating of the high viscosity blend component. The temperature of the high viscosity blend component or additive should be below 110° C., preferably below 91° C., and more preferably below 51° C.

The accuracy of lubricant blends made with high viscosity lubricant blend components and method of the present invention may be further improved by simultaneously measuring the weight and volume delivered to the blend vessel. This may be done by comparing the volume pipetted by the LVVPDP to the volume calculated by multiplying the measured mass with the density of the high viscosity component stored in the computer. If the volume and mass measurements are not in agreement than an error condition may be reported by the computer.

In another exemplary embodiment of the present invention, density of a high viscosity lubricant component may be accurately measured while simultaneously making lubricant blends via the computer or programmable logic controller. This is done by using the volume and mass measurements made by the computer for each high viscosity lubricant component.

In yet another exemplary embodiment of the present invention, density of a high viscosity lubricant component may be measured over a range of temperatures by varying the temperature of the high viscosity lubricant components and measuring the volume and mass. The density is then calculated by the computer or programmable logic controller by dividing the mass by the volume.

In still yet another embodiment of the present invention, the identity of a given high viscosity lubricant component may be verified by comparing the density measured as above with an expected density stored in a computer database. If the two densities agree within a certain tolerance, than the identity of the high viscosity lubricant component is known to be correct. If the densities fall outside this tolerance than either the wrong high viscosity lubricant component has been used or its density is outside of the specification.

The accuracy of dispensing a given amount of lubricant additives can be further improved by using a combination of a large LVVPDP or a conventional pipette with a small LVVPDP. The large LVVPDP or the conventional pipette is used to dispense 90-99% of the target quantity and the actual quantity added is determined by the balance. The computer or the programmable logic controller then calculates the remaining amount to be added by the small LVVPDP. An automated feedback routine can be used to further improve the dispensing of lubricant additives from LVVPDPs and conventional pipettes.

The lubricant blend station including LVVPDPs for dispensing high viscosity additives of the present invention are suitable for laboratory applications where the blend quantities are relatively small. The lubricant blend station including LVVPDPs for dispensing high viscosity additives of the present invention are also suitable for high throughout experimentation (HTE) type applications. These applications do not limit the range of other applications for blending lubricants and lubricant additives where the lubricant blend station of the present invention may be utilized.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

The following examples illustrate the present invention and the advantages thereto without limiting the scope thereof.

EXAMPLES

Example 1

Three lubricant additives were dispensed using the 10 μl Gilson Microman low void volume positive displacement pipettes (Type CP10) and the results are compared with those obtained using the Tecan Liquid Handling device which is based on air/liquid displacement. The descriptions and the typical properties of the additives used are given in Table 2.

TABLE 2

Descriptions and Typical Properties of the Additives Used in Example 1

| | Paratone 8011 | Infineum D3426 | Infineum V387 |
|---|---|---|---|
| Additive Type | VI Improver | Additive Package | Pour Point Depressant |
| Kinematic Viscosity at 100 C., cSt | 1025 | 190 | 85 |
| Kinematic Viscosity at 40 C., cSt | — | 4112 | 740 |

It was found that the low void positive displacement pipettes Gilson Microman M10 gave excellent results at room temperature while the Tecan RSP100 liquid handling system could not handle the same components at room temperature. The results obtained using the Microman M10 is given in Table 3. In comparison, the data from the Tecan liquid handling system is given in Table 4.

TABLE 3

Dispensing Precision of the Microman M10 LVPDPs (Target 10.0 μl, Room Temp)

| | Paratone 8011 grams | Infineum D 3426 grams | Infineum V387 grams |
|---|---|---|---|
| Dispense #1 | 0.0078 | 0.0090 | 0.0083 |
| Dispense #2 | 0.0079 | 0.0091 | 0.0080 |
| Dispense #3 | 0.0081 | 0.0093 | 0.0085 |
| Dispense #4 | 0.0080 | 0.0095 | 0.0081 |
| Dispense #5 | 0.0080 | 0.0091 | 0.0084 |
| Dispense #6 | 0.0078 | 0.0093 | 0.0084 |
| Dispense #7 | 0.0080 | 0.0094 | 0.0083 |
| Dispense #8 | 0.0080 | 0.0091 | 0.0083 |
| Dispense #9 | 0.0079 | 0.0092 | 0.0081 |
| Dispense #10 | 0.0080 | 0.0091 | 0.0085 |
| Average | 0.0080 | 0.0092 | 0.0083 |
| Standard Deviation | 0.00010 | 0.00016 | 0.00017 |
| % Coefficient of Variation | 1.22 | 1.73 | 2.09 |

TABLE 4

Dispensing precision of Tecan RSP100 liquid handling System (Target 12.5 μl, Room Temp)

| | Paratone 8011 grams | Infineum D3426 grams | Infineum V387 grams |
|---|---|---|---|
| Dispense #1 | 0.00546 | 0.00939 | 0.00932 |
| Dispense #2 | 0.00527 | 0.0108 | 0.00987 |
| Dispense #3 | 0.0035 | 0.01015 | 0.00957 |
| Dispense #4 | 0.00639 | 0.00994 | 0.00983 |

TABLE 4-continued

Dispensing precision of Tecan RSP100 liquid handling System (Target 12.5 μl, Room Temp)

| | Paratone 8011 grams | Infineum D3426 grams | Infineum V387 grams |
|---|---|---|---|
| Dispense #5 | 7E−05 | 0.00912 | 0.00989 |
| Dispense #6 | 0.00542 | 0.00959 | 0.00949 |
| Dispense #7 | 0.00012 | 0.00886 | 0.00949 |
| Dispense #8 | 0.00018 | 0.00874 | 0.00935 |
| Dispense #9 | 0.00666 | 0.01016 | 0.00927 |
| Dispense #10 | 0.00629 | 0.01011 | 0.00974 |
| Dispense #11 | 0.00616 | 0.01046 | 0.00938 |
| Dispense #12 | 0.00563 | 0.00981 | 0.00973 |
| Average | 0.00426 | 0.00976 | 0.00958 |
| Standard Deviation | 0.002622 | 0.000637 | 0.000226 |
| % Coefficient of Variation | 61.52 | 6.53 | 2.36 |

Example 2

It was also found that Microman M100 (100 μl) low void positive displacement pipettes also gave excellent dispensing precision at room temperature when compared with Tecan RSP100 liquid handling system. The results obtained using the Microman M10 is given in Table 5. In comparison, the data from the Tecan liquid handling system is given in Table 6.

TABLE 5

Dispensing Precision of the Microman M100 LVPDPs (Target 100.0 μl, Room Temp)

| | Paratone 8011 grams | Infineum D3426 grams | Infineum V387 grams |
|---|---|---|---|
| Dispense #1 | 0.086 | 0.094 | 0.086 |
| Dispense #2 | 0.0859 | 0.0939 | 0.0859 |
| Dispense #3 | 0.086 | 0.0936 | 0.0856 |
| Dispense #4 | 0.0861 | 0.0935 | 0.0858 |
| Dispense #5 | 0:0859 | 0.0938 | 0.0861 |
| Dispense #6 | 0.086 | 0.094 | 0.0859 |
| Dispense #7 | 0.0861 | 0.0937 | 0.0858 |
| Dispense #8 | 0.086 | 0.0935 | 0.0857 |
| Dispense #9 | 0.0861 | 0.0939 | 0.0856 |
| Dispense #10 | 0.0859 | 0.0936 | 0.0858 |
| Average | 0.086 | 0.09375 | 0.08582 |
| Standard Deviation | 0.00008 | 0.00020 | 0.00016 |
| % Coefficient of Variation | 0.095 | 0.209 | 0.189 |

TABLE 6

Dispensing precision of Tecan RSP100 liquid handling System (Target 125 μl, Room Temp)

| | Paratone 8011 grams | Infineum D3426 grams | Infineum V387 grams |
|---|---|---|---|
| Dispense #1 | 0.02438 | 0.0478 | 0.11589 |
| Dispense #2 | 0.01614 | 0.03666 | 0.115 |
| Dispense #3 | 0 | 0.00935 | 0.11019 |
| Dispense #4 | 0 | 0.00995 | 0.11077 |
| Dispense #5 | 0.00345 | 0.01134 | 0.11143 |
| Dispense #6 | 0.00803 | 0.01256 | 0.11477 |
| Dispense #7 | 0.01981 | 0.03488 | 0.12335 |
| Dispense #8 | 0.01368 | 0.0295 | 0.11597 |
| Dispense #9 | 0.01262 | 0.02792 | 0.11578 |
| Dispense #10 | 0.01449 | 0.02479 | 0.11587 |

TABLE 6-continued

| Dispensing precision of Tecan RSP100 liquid handling System (Target 125 µl, Room Temp) | | | |
|---|---|---|---|
| | Paratone 8011 grams | Infineum D3426 grams | Infineum V387 grams |
| Dispense #11 | 0.01894 | 0.02808 | 0.11596 |
| Dispense #12 | 0.00852 | 0.02679 | 0.11578 |
| Average | 0.01167 | 0.02497 | 0.11506 |
| Standard Deviation | 0.00784 | 0.01209 | 0.00341 |
| % Coefficient of Variation | 67.20 | 48.42 | 2.97 |

Example 3

Paratone 8011 was dispensed at room temperature, 50° C. and 90° C. using 2.5 ml Jencons Scientific positive displacement pipettes (488-008) with and without modification. A razor blade was used to cut the pipette tip to remove the air space near the end of the tip. The modification reduces the void of the pipette. It was found that the modification leads to improvement in dispensing precision at room temperature and at 50° C. However at 90° C., no advantage was observed. The data are given in Table 7.

TABLE 7

Dispense of Paratone 8011 at Room Temperature, 50° C., and 90° C. using 2.5 ml Jencons Scientific pipettes with and without modifications.

| | Room Temp | | 50° C. | | 90° C. | |
|---|---|---|---|---|---|---|
| | Regular PDP grams | Modified PDP grams | Regular PDP grams | Modified PDP grams | Regular PDP grams | Modified PDP grams |
| Dispense #1 | 2.135 | 2.167 | 2.134 | 2.141 | 2.118 | 2.093 |
| Dispense #2 | 2.152 | 2.162 | 2.145 | 2.149 | 2.120 | 2.121 |
| Dispense #3 | 2.158 | 2.163 | 2.127 | 2.146 | 2.107 | 2.102 |
| Dispense #4 | 2.166 | 2.166 | 2.128 | 2.154 | 2.118 | 2.099 |
| Dispense #5 | 2.153 | 2.152 | 2.144 | 2.158 | 2.127 | 2.124 |
| Dispense #6 | 2.139 | 2.171 | 2.133 | 2.142 | 2.098 | 2.131 |
| Dispense #7 | 2.140 | 2.157 | 2.130 | 2.150 | 2.107 | 2.114 |
| Dispense #8 | 2.148 | 2.175 | 2.149 | 2.146 | 2.114 | 2.123 |
| Dispense #9 | 2.143 | 2.161 | 2.124 | 2.137 | 2.084 | 2.122 |
| Dispense #10 | 2.131 | 2.159 | 2.115 | 2.137 | 2.108 | 2.107 |
| Average | 2.146 | 2.163 | 2.133 | 2.146 | 2.110 | 2.114 |
| Standard Deviation | 0.011 | 0.007 | 0.010 | 0.007 | 0.012 | 0.013 |
| % Coefficient of Variation | 0.502 | 0.311 | 0.488 | 0.322 | 0.587 | 0.594 |

What is claimed is:

1. A method of dispensing small amounts of high viscosity lubricant components with tubeless positive displacement pipettes with improved accuracy to form a lubricant blend, the improvement comprising the following steps:

providing a low void volume positive displacement pipette for each lubricant component contained within a lubricant additive reservoir, and one or more lubricant blend containers, the containers having less than about 100 ml total volume;

ingesting into said low void volume positive displacement pipette from the lubricant additive reservoir an ingestion volume of a lubricant component;

moving said low void volume positive displacement pipette from said lubricant additive reservoir to said one or more lubricant blend containers;

ejecting into said one or more lubricant blend containers an ejection volume of said lubricant component from said low void volume positive displacement pipette at a rate below a preselected threshold shear rate;

returning said low void volume positive displacement pipette from said one or more lubricant blend containers to said additive reservoir; and repeating said ingesting, said moving, said ejecting and said returning steps for each additional lubricant component.

2. The method of claim 1 further comprising the steps of:

providing a balance for weighing a mass of said one or more lubricant blend containers; and controlling an actual mass of each lubricant component ejected into said one or more lubricant blend containers with said balance.

3. The method of claim 1 further comprising the step of heating one or more high viscosity lubricant components to a temperature below about 110° C. prior to said ingesting step.

4. The method of claim 3 further comprising the step of heating one or more high viscosity lubricant components to a temperature below about 91° C. prior to said ingesting step.

5. The method of claim 4 further comprising the step of beating one or more high viscosity lubricant components to a temperature below about 51° C. prior to said ingesting step.

6. The method of claim 1, wherein said ingesting step is at a shear rate of less than about $5\times10^6$ $sec^{-1}$.

7. The method of claim 6, wherein said ingesting step is at a shear rate of less than about $1\times10^6$ $sec^{-1}$.

8. The method of claim 1, wherein said ejecting step is at a shear rate of less than about $1\times10^5$ $sec^{-1}$.

9. The method of claim 8, wherein said ejecting step is at a shear rate of less than about $1\times10^4$ $sec^{-1}$.

10. The method of claim 1 or 2, further comprising the steps of:

providing a robotic means coupled to a computer or programmable logic controller for controlling said low void volume positive displacement pipette; and using said robotic means coupled to a computer or programmable logic controller for automating said ingesting, said moving, said ejecting, said returning and said repeating steps.

11. The method of claim 10, wherein said computer or programmable logic controller is used to measure a volume of said lubricant component ejected from said low void volume positive displacement pipette.

12. The method of claim 11, wherein said computer or programmable logic controller is further used to measure a calculated mass of said lubricant component ejected from said low void volume positive displacement pipette by multiplying the density of said lubricant component by the volume ejected of said lubricant component.

13. The method of claim 12, wherein said computer or programmable logic controller is further used to measure a calculated density of said lubricant component ejected from said low void volume positive displacement pipette by dividing said calculated mass by said volume of said lubricant component ejected from said low void volume positive displacement pipette.

14. The method of claim 13, wherein said computer or programmable logic controller is further used to measure an actual density of said lubricant component ejected from said low void volume positive displacement pipette by dividing said actual mass by said volume of said lubricant component ejected from said low void volume positive displacement pipette.

15. The method of claim 14, wherein said computer or programmable logic controller is further used to verify the identity of said lubricant component ejected from said low void volume positive displacement pipette by comparing said actual density and said calculated density of said lubricant component, and determining that the difference is within a specified offset.

16. The method of claim 10 wherein said computer or programmable logic controller is programmed with one or more lubricant blend recipes.

17. The method of claim 10 wherein said robotic means comprises a robotic arm connected to a support bridge.

18. The method of claim 1 wherein said lubricant component is selected from the group consisting of base oils, VI improvers, dispersants, detergents, pour point depressants, polyisobutylenes, high molecular weight polyalphaolefins, antiwear/extreme pressure agents, antioxidants, demulsiflers, seal swelling agents, friction modifiers, corrosion inhibitors, antifoam additives, and mixtures thereof.

19. The method of claim 1 wherein said lubricant component has a viscosity greater than about 500 centipoise at 100° C.

20. The method of claim 19 wherein said lubricant component has a viscosity greater than about 1000 centipoise at 100° C.

21. The method of claim 1 wherein said lubricant additive reservoir is covered by a septum.

22. The method of claim 1 wherein said lubricant blend container is less than 100 milliliters in volume.

23. The method of claim 22 wherein said lubricant blend container is less than 10 milliliters in volume.

24. The method of claim 1 wherein said low void volume positive displacement pipette is disposable.

25. The method of claim 1 wherein said method is used in high throughput experimentation type applications.

26. The method of claim 1 wherein said low void volume positive displacement pipette has a void volume less than 1 milliliter.

27. The method of claim 26 wherein said low void volume positive displacement pipette has a void volume less than 0.5 milliliter.

28. The method of claim 27 wherein said low void volume positive displacement pipette has a void volume Jess than 0.05 milliliter.

29. The method of claim 28 wherein said low void volume positive displacement pipette has a void volume less than 0.5 microliter.

30. The method of claim 29 wherein said low void volume positive displacement pipette has essentially no void volume.

31. The method of claim 1 wherein said low void volume positive displacement pipette has a tapered tip with a void volume of less than 30% of the total volume of said tapered tip.

32. The method of claim 1 wherein said low void volume positive displacement pipette has a tapered tip with a void volume of less than 10% of the total volume of said tapered tip.

33. The method of claim 1 wherein said low void volume positive displacement pipette has a tapered tip with a void volume of less than 2% of the total volume of said tapered tip.

34. The method of claim 1 further comprising the step of using a small low void volume positive displacement pipette to improve the dispense accuracy in combination with a large low void volume, positive displacement pipette or a conventional pipette.

35. A method of dispensing high viscosity lubricant components with tubeless positive displacement pipettes with improved accuracy to form a lubricant blend comprising the following steps:

providing a low void volume positive displacement pipette for each lubricant component contained within a lubricant additive reservoir, a heating means for said lubricant additive reservoir, one or more lubricant blend containers, having a total volume less than about 100 ml, a balance for weighing a mass of said one or more lubricant blend containers, and a robotic means coupled to a computer or programmable logic controller for coordinating and controlling the following steps;

heating one or more lubricant components wit a high viscosity to a temperature below about 110° C.;

ingesting into said low void volume positive displacement pipette from the lubricant additive reservoir an ingestion volume of a lubricant component;

moving said low void volume positive displacement pipette from said lubricant additive reservoir to said one or more lubricant blend containers;

ejecting into said one or more lubricant blend containers an ejection volume of said lubricant component from said low void volume positive displacement pipette at a rate below a preselected threshold shear rate;

weighing and controlling an actual mass of each lubricant component ejected into said one or more lubricant blend containers with said balance;

returning said low void volume positive displacement pipette from said one or more lubricant blend containers to said additive reservoir; and repeating said ingesting, said moving, said ejecting, said weighing and said returning steps for each additional lubricant component.

36. The method of claim 35 wherein said lubricant component is selected from the group consisting of base oils, VT improvers, dispersants, detergents, pour point depressants, polyisobutylenes, high molecular weight polyalphaolefins, antiwear/extreme pressure agents, antioxidants, demulsiflers, seal swelling agents, friction modifiers, corrosion inhibitors, antifoam additives, and mixtures thereof.

37. The method of claim 36 wherein said one or more lubricant components with a high viscosity is selected from the group consisting of VI improvers, dispersants, pour point depressants, polyisobutylenes, high molecular weight polyalphaolefins, and additive packages including one or more of said lubricant components with a high viscosity.

38. The method of claim 35, wherein said ejecting step is at a shear rate of less than about $1\times10^5$ $sec^{-1}$.

39. The method of claim 35, wherein said computer or programmable logic controller is used to measure a volume of said lubricant component ejected from said low void volume positive displacement pipette.

40. The method of claim 39, wherein said computer or programmable logic controller is further used to measure a calculated mass of said lubricant component ejected from said low void volume positive displacement pipette by multiplying the density of said lubricant component by the volume ejected of said lubricant component.

41. The method of claim 40, wherein said computer or programmable logic controller is further used to measure a calculated density of said lubricant component ejected from said low void volume positive displacement pipette by dividing said calculated mass by said volume of said lubricant component ejected from said low void volume positive displacement pipette.

42. The method of claim 41, wherein said computer or programmable logic controller is further used to measure an actual density of said lubricant component ejected from said low void volume positive displacement pipette by dividing said actual mass by said volume of said lubricant component ejected from said low void volume positive displacement pipette.

43. The method of claim 42, wherein said computer or programmable logic controller is further used to verify the identity of said lubricant component ejected from said low void volume positive displacement pipette by comparing said actual density and said calculated density of said lubricant component, and determining that the difference is within a specified offset.

44. The method of claim 35 wherein said computer or programmable logic controller is programmed with one or more lubricant blend recipes.

45. The method of claim 35 wherein said robotic means comprises a robotic arm connected to a support bridge.

46. The method of claim 35 wherein said method is used in high throughput experimentation type applications.

47. The method of claim 35 wherein said low void volume positive displacement pipette has a tapered tip with a void volume of less than 30% of the total volume of said tapered tip.

48. A method of dispensing high viscosity lubricant components with tubeless positive displacement pipettes to form a lubricant blend comprising the following steps:

providing a low void volume positive displacement pipette for each lubricant component contained within a lubricant additive reservoir, a heating means for said lubricant additive reservoir, one or more lubricant blend containers with a volume less than 10 milliliters, a balance for weighing a mass of said one or more lubricant blend containers, and a robotic arm connected to a support bridge coupled to a computer or programmable logic controller programmed with one or more lubricant blend recipes for coordinating and controlling the following steps;

heating one or more lubricant components with a viscosity greater than about 500 centipoise at 100° C. to a temperature of less than about 110° C.;

ingesting into said low void volume positive displacement pipette from the lubricant additive reservoir an ingestion volume of a lubricant component;

moving said low void volume positive displacement pipette from said lubricant additive reservoir to said one or more lubricant blend containers;

ejecting into said one or more lubricant blend containers an ejection volume of said lubricant component from said low void volume positive displacement pipette at a shear rate of less than about $1\times10^5$ $sec^-$;

weighing and controlling an actual mass of each lubricant component ejected into said one or more lubricant blend containers with said balance;

returning said low void volume positive displacement pipette from said one or more lubricant blond containers to said additive reservoir; and repeating said ingesting, said moving, said ejecting, said weighing and said returning steps for each additional lubricant component.

49. The method of claim 48 wherein said one or more lubricant components with a viscosity greater than about 500 centipoise at 100° C. is selected from the group consisting of VI improvers, dispersants, pour point depressants, polyisobutylenes, high molecular weight polyalphaolcfins, and mixtures thereof

50. The method of claim 48, wherein said computer or programmable logic controller is used to measure a volume of said lubricant component ejected from said low void volume positive displacement pipette.

51. The method of claim 50, wherein said computer or programmable logic controller is further used to measure a calculated mass of said lubricant component ejected from said low void volume positive displacement pipette by multiplying the density of said lubricant component by the volume ejected of said lubricant component.

52. The method of claim 51, wherein said computer or programmable logic controller is further used to measure a calculated density of said lubricant component ejected from said low void volume positive displacement pipette by dividing said mass by said volume of said lubricant component ejected from said low void volume positive displacement pipette.

53. The method of claim 52, wherein said computer or programmable logic controller is further used to measure an actual density of said lubricant component ejected from said low void volume positive displacement pipette by dividing said actual mass by said volume of said lubricant component ejected from said low void volume positive displacement pipette.

54. The method of claim 53, wherein said computer or programmable logic controller is further used to verify the identity of said lubricant component ejected from said low void volume positive displacement pipette by comparing said actual density and said calculated density of said lubricant component, and determining that the difference is within a specified offset.

55. The method of claim 48 wherein said low void volume positive displacement pipette has a tapered tip with a void volume of less than 30% of the total volume of said tapered tip.

56. The method of claim 48 wherein said method is used in high throughput experimentation type applications.

* * * * *